US008424164B2

(12) United States Patent
Gill

(10) Patent No.: US 8,424,164 B2
(45) Date of Patent: Apr. 23, 2013

(54) FLEXIBLE GRIP WITH PARTIALLY TEXTURED SURFACE AND METHOD OF MAKING SAME

(75) Inventor: David Keith Gill, Pinehurst, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/176,141

(22) Filed: Jul. 5, 2011

(65) Prior Publication Data

US 2012/0137472 A1 Jun. 7, 2012

Related U.S. Application Data

(60) Provisional application No. 61/418,964, filed on Dec. 2, 2010.

(51) Int. Cl.
*A45C 13/26* (2006.01)
*B25G 1/10* (2006.01)

(52) U.S. Cl.
USPC ..... 16/430; 16/421

(58) Field of Classification Search ..... 16/421, 16/422, 430, DIG. 12, DIG. 18, DIG. 19; 473/300, 301, 302, 303; 74/551.9; 401/6; 81/489, 177.1
See application file for complete search history.

(56) References Cited

U.S. PATENT DOCUMENTS

| | | | | |
|---|---|---|---|---|
| 5,795,242 | A * | 8/1998 | Ree | 473/303 |
| 6,197,392 | B1 * | 3/2001 | Jones | 428/34.9 |
| 6,649,803 | B2 * | 11/2003 | Mart et al. | 585/734 |
| 7,140,973 | B2 * | 11/2006 | Rohrer | 473/300 |
| 7,485,050 | B2 * | 2/2009 | Rose | 473/303 |
| 2002/0142857 | A1 * | 10/2002 | Huang | 473/300 |
| 2004/0109980 | A1 * | 6/2004 | Chen et al. | 428/131 |
| 2004/0121850 | A1 * | 6/2004 | Rohrer | 473/300 |
| 2004/0165931 | A1 * | 8/2004 | Cooper et al. | 401/6 |
| 2007/0082748 | A1 * | 4/2007 | Rose | 473/300 |
| 2007/0082750 | A1 * | 4/2007 | Rose | 473/300 |
| 2009/0048036 | A1 * | 2/2009 | Huang | 473/303 |
| 2009/0113669 | A1 * | 5/2009 | Gill | 16/110.1 |

* cited by examiner

*Primary Examiner* — Chuck Y. Mah
(74) *Attorney, Agent, or Firm* — Fay Sharpe LLP

(57) ABSTRACT

A flexible molded grip for an implement handle having a pattern on the surface of portions raised above adjacent areas, with the surfaces of the raised portions textured. The raised textured portions may extend in the range of about 0.5 mm to 2 mm above the intermediate smooth portions. The area of each of the raised portions may be in the range of about 100-200 percent (%) of the area of the intermediate spaces. The pattern of raised portions may include patterns such as polygonal, circular, oval and elliptical patterns. The method includes forming raised portions in a mold and forming textured surfaces on the raised portions after removal from the mold.

3 Claims, 5 Drawing Sheets

FLEXIBLE GRIP WITH PARTIALLY TEXTURED SURFACE AND METHOD OF MAKING SAME

This patent application claims priority from Provisional Patent Application No. 61/418,964, filed Dec. 2, 2010, entitled "FLEXIBLE GRIP WITH PARTIALLY TEXTURED SURFACE," by David Keith Gill and is totally incorporated by reference herein in its entirety.

BACKGROUND

The present disclosure relates to flexible grips of the type employed on implement handles such as tools and sporting goods. Flexible grips are often assembled over a solid or hollow handle of hand tools such as hammers, hatchets and axes and sporting goods such as tennis rackets, golf clubs, and the like. Flexible grips for the aforesaid applications are usually molded of flexible material such as rubber, elastomeric material or highly plasticized plastic material to give a resilient or "soft" feel to the individual applying a hand hold to the grip portion of the handle of the implement.

Heretofore, flexible molded hand grips have been provided with either a textured surface, or a smooth or "shiny" surface from the mold dependent upon the desired finish and appearance of the grip. It has also been known to provide portions of the grip provided with recessed patterns or designs for giving an aesthetic appearance to the grip or for providing a decorative design logo.

The advantages of a smooth or "shiny" grip are that when employed on a material of sufficient softness, a "tacky" or "sticky" feel is exhibited to the user thereby improving the frictional retention of the grip in the user's hand upon usage, as for example where the implement is swung with force and speed as is the case for a hammer or golf club.

Thus, it has been desired to provide a way or means of improving the gripability and aesthetic appearance of a flexible grip for an implement.

SUMMARY

The present disclosure describes a flexible grip for an implement handle of the type molded from flexible material such as rubber, elastomer or highly plasticized plastic which has a pattern on the surface thereof formed of alternate or interspersed areas that are slightly raised. The surface of the raised portions is textured such as by buffing after molding with the recessed areas between the raised portions provided with a smooth, i.e. glossy or shiny surfaced. The raised textured portions may extend above the recessed smooth portions of the pattern by an amount in the range of about 0.5 mm to 2 mm. The patterns employed for the raised buffed portions produce raised areas in the range of about 100% to 200% of the area of the recessed glossy portions in order to retain a tactilely discernable engagement with the recessed glossy portions and to provide improved gripping characteristics for the user.

DETAILED DESCRIPTION

Figure 1:
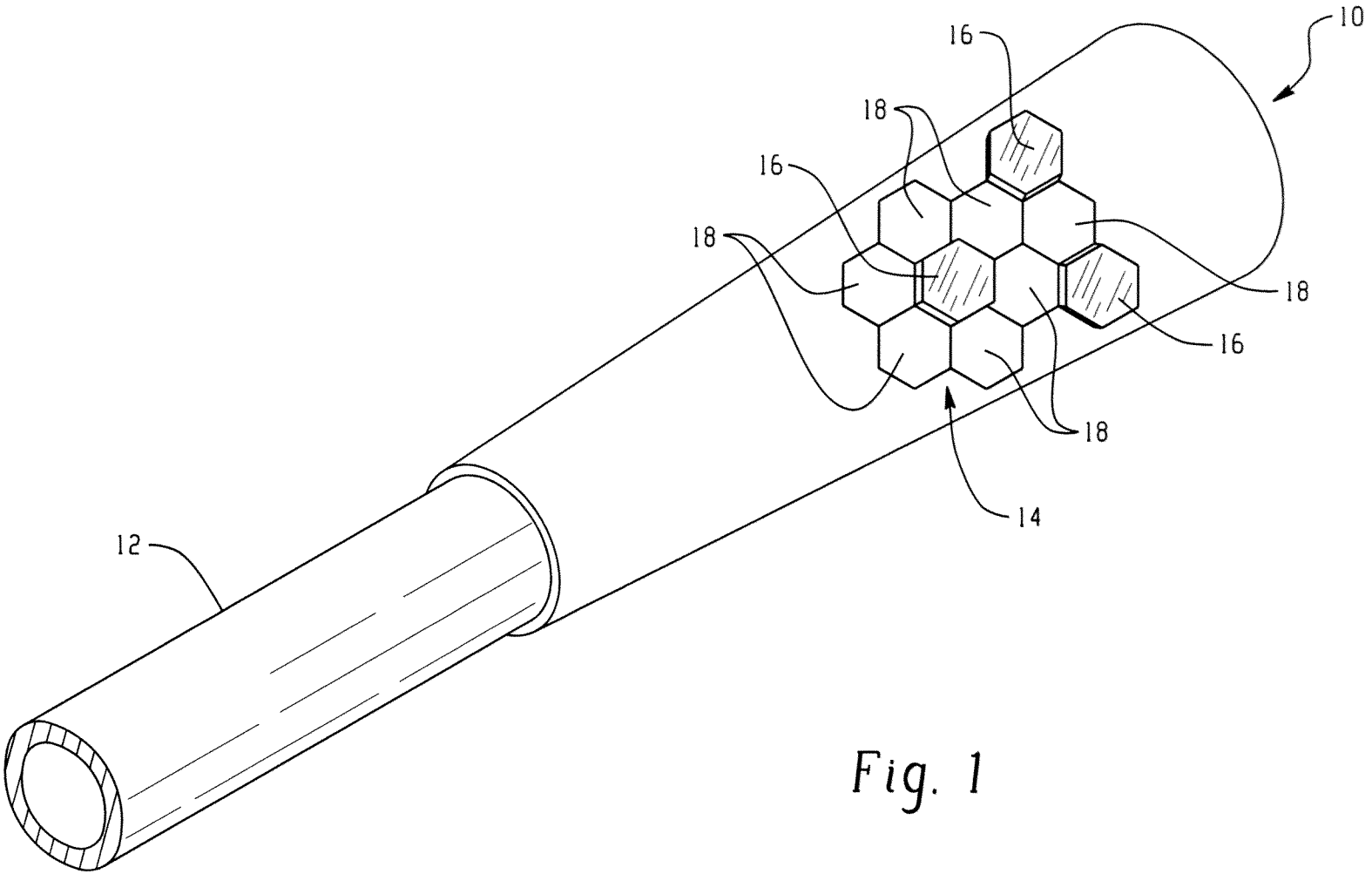
FIG. 1 is a perspective view of a flexible grip of the present disclosure assembled onto the handle of an implement.
Figure 2:
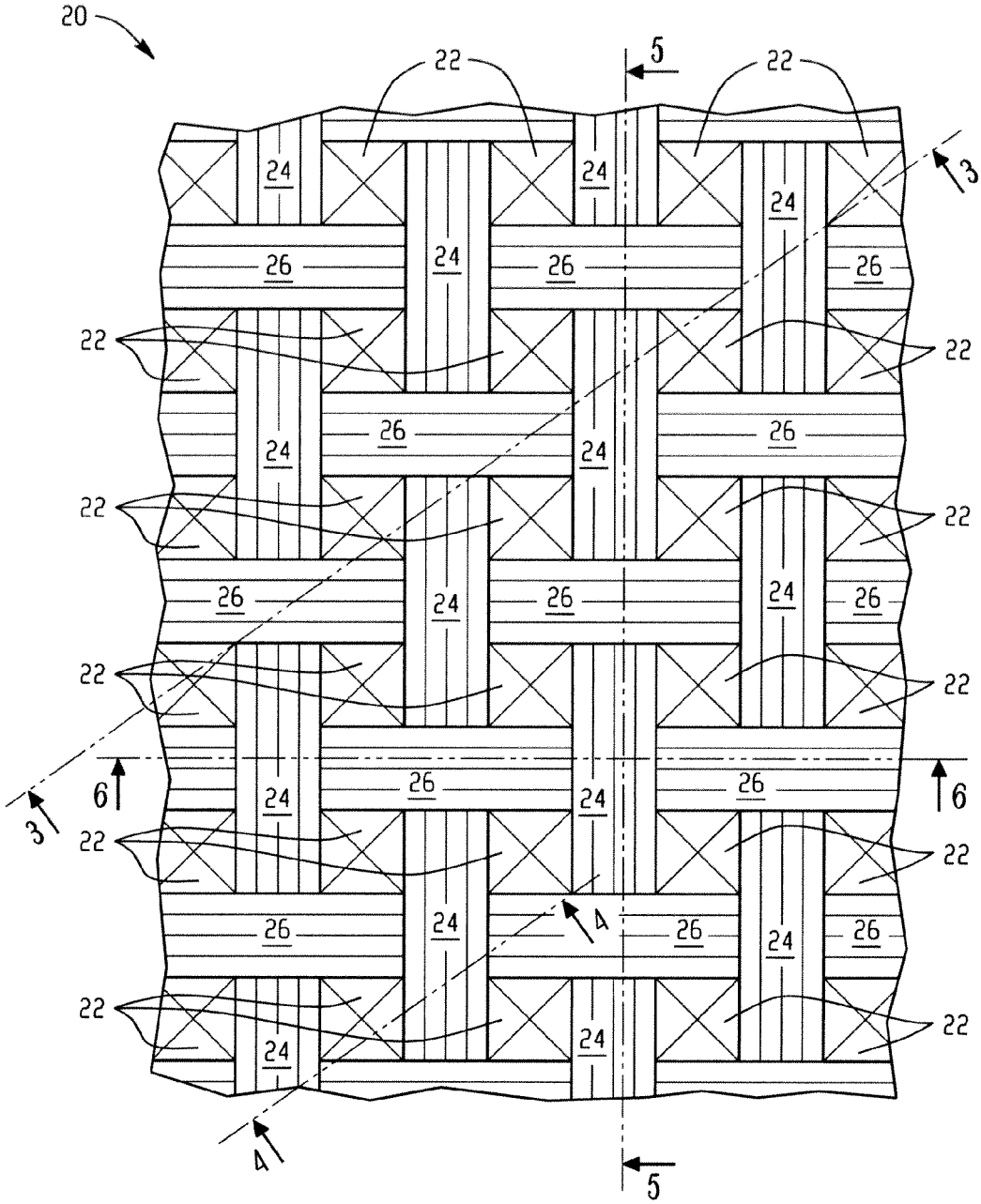
FIG. 2 is a plan view of a portion of one version of a textured pattern employed for the grip of FIG. 1.
Figure 3:
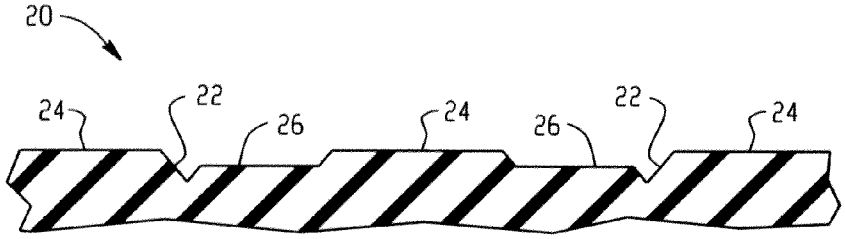
FIG. 3 is a section view taken along section indicating lines 3-3 of FIG. 2.
Figure 7:
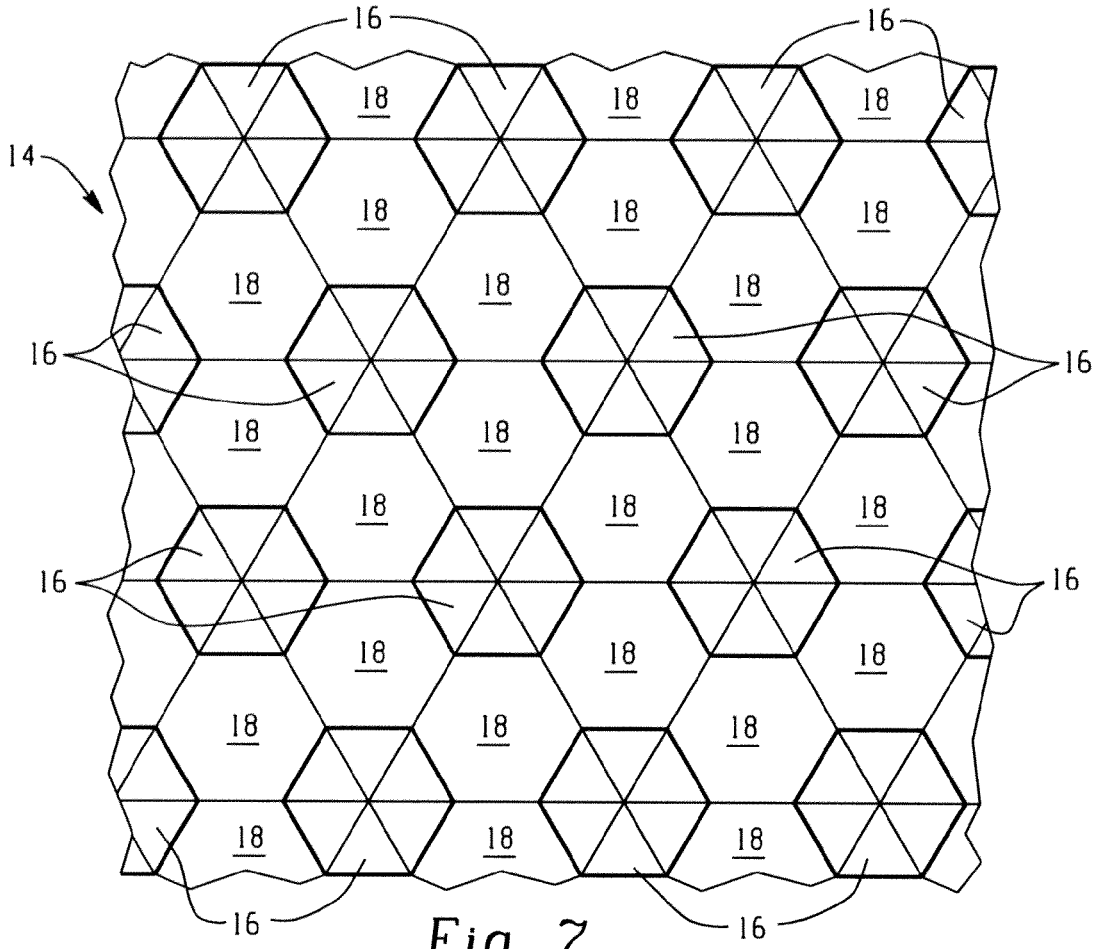
FIG. 7 is plan view of another version of a textured pattern for the grip of FIG. 1.

Referring to FIG. 1, a flexible grip indicated generally at 10 is assembled over an end of an implement handle 12 which is illustrated in a widely used form on a tubular member. It will be understood that the distal end of the grip 10 in FIG. 1 is closed or substantially closed. The grip 10 employs a pattern indicated generally at 14 which is intended to be continuous over the surface of grip but which is shown on only a portion thereof for simplification of illustration. The pattern or grip 14 has raised portions 16 illustrated in FIG. 1 as having a hexagonal configuration. The areas between the raised portion 16 are denoted as having slight groove to provide a hexagonal configuration and are shown as unshaded and denoted by reference numeral 18. The pattern employed in the embodiment 10 of FIG. 1 is shown in greater detail in FIG. 7 wherein the raised portions are denoted as hexagons with the opposite vertices thereof interconnected by straight lines passing through the center of the hexagonal shape and correspond to the shaded hexagonal areas 16 in FIG. 1. In the present practice, the grip 10 is formed by inserting uncured rubber or other curable material in a mold with surfaces of the mold configured to form the pattern of raised areas and curing or vulcanizing the grip in the mold. Alternatively, polygonal shapes other than hexagonal, for example octagonal, may be employed.

In the present practice, the grip 10 is formed by inserting uncured rubber or other curable material in a mold with surfaces of the mold configured to form the pattern of raised areas and curing or vulcanizing the grip in the mold. The surface of the raised areas 16 may be molded shiny and then buffed, after the grip is removed from the mold, to give a textured finish for enhancing gripability and to give a desired appearance to the grip. In the present practice, it has been found satisfactory to form the pattern 14 such that the area of each of the raised portions 16 is in the range of about 100-200% of the area of each of the recessed portions 18. In the present practice, it has been found satisfactory to configure a mold to form the raised portions 16 with a transverse surface dimension or width in the range of about 2 mm to 10 mm and a height in the range of about 0.5 mm to 2 mm.

Referring to FIGS. 2-6, another embodiment of the pattern employed in the grip 10 is indicated generally at 20 and comprises raised areas of a generally rectangular configuration giving a woven appearance with intermediate recessed portions. Smaller square regions, cross-hatched with letter X, arranged at right angles thereto denoted by reference numerals 22 are provided at the intersection of regions 24 and 26 and are recessed the greatest amount. The areas illustrated with spaced parallel lines denoted by reference numeral 24 are raised portions with surface buffed to have a textured appearance; and, the portions denoted by reference numeral 26 are recessed areas of glossy or shiny finish. The areas denoted by reference numeral 24 are raised from the areas denoted by reference numeral 26 by an amount denoted by the reference character "h" in FIG. 5. In the present practice, it has been found satisfactory to have the dimension "h" in the range of about 0.5 mm to 2 mm to give the desired tactily discernable feel to the grip. In the present practice, each of the areas 24, 26 are of about equal area.

Figure 4:
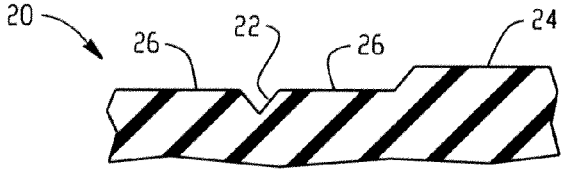
FIG. 4 is a portion of a section view taken along section indicating lines 4-4 of FIG. 2.
Figure 5:
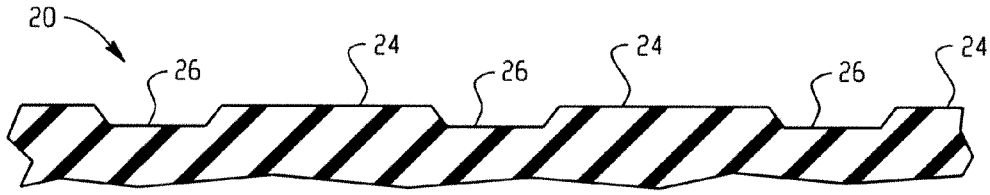
FIG. 5 is a portion of a section view taken along section indicating lines 5-5 of FIG. 2.
Figure 6:
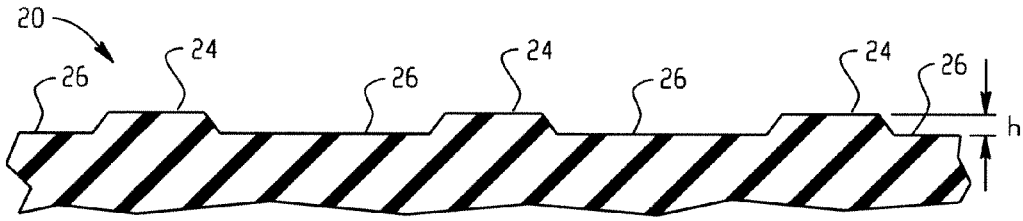
FIG. 6 is a portion of a section view taken along section indicating lines 6-6 of FIG. 2.

Referring to FIGS. 4, 5 and 6, the relationship of the intermediate areas 22 forming squares between the warp and weft configuration of the pattern 20 are shown in their occurrence as only in the square portions 22 intermediate the intersections of the textured raised portions 24 and the recessed portions 26. In the present practice, the areas 22 may have a depth of about "h".

Figure 8:
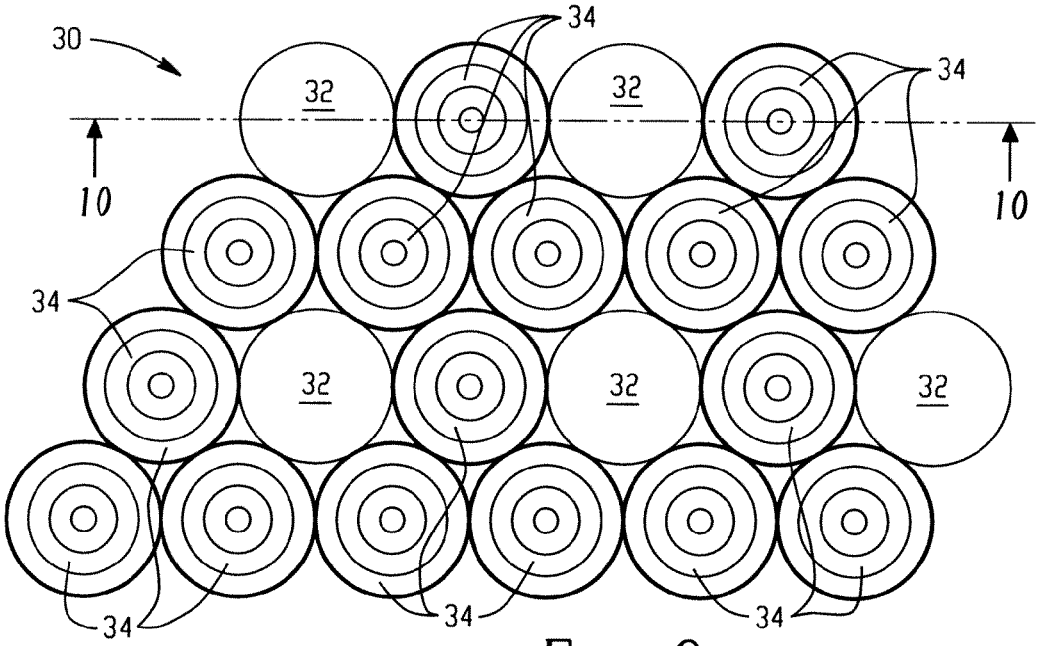
FIG. 8 is a plan view of another version of a textured pattern for the grip of FIG. 1.
Figure 10:
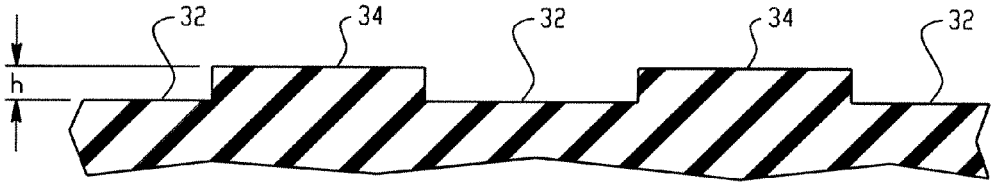

Referring to FIG. 8, another version of a textured pattern for the grip 10 of FIG. 1 is illustrated and denoted generally at 30 and comprises a pattern formed of rows of raised circular areas 34 of generally the same diameter and intermediate recessed circular areas 32 are surrounded by the circular raised areas 34. Alternatively, the circular raised areas may have other shapes, as for example, elliptical or oval. The areas 34 are raised from the surface 32 by the amount designated by the reference character "h" shown in FIG. 10 and in the range previously described.

In the present practice it has been found satisfactory to form each of the raised areas 34 and recessed areas 32 of about equal area.

Figure 9:
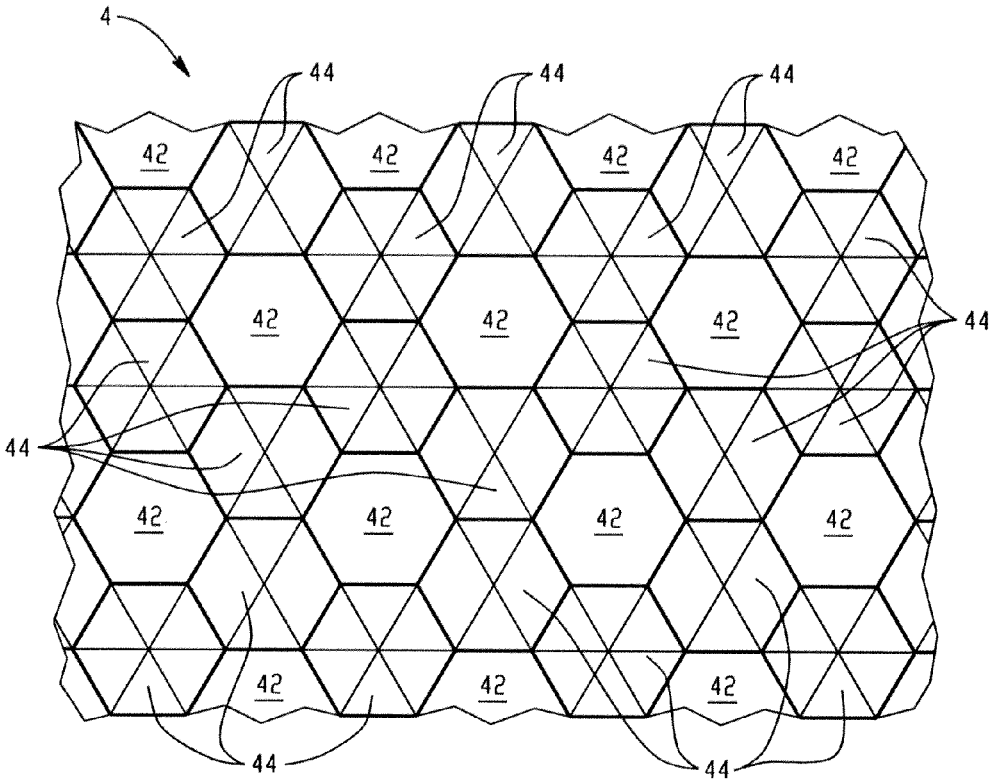
FIG. 9 is a plan view of another version of a textured pattern for the grip of FIG. 1; and, FIG. 10 is a portion of a section view taken along section indicating lines 10-10 of FIG. 8.

Referring to FIG. 9, another version of a hexagonal pattern for the grip of FIG. 1 is indicated generally at 40 and has a plurality of recessed hexagonal areas 42, each of which is surrounded on its six sides by corresponding hexagonal raised portions denoted by reference numeral 44. In FIG. 9, the raised areas 44 are illustrated with lines connecting opposite vertices thereof. In the present practice, each of the raised portions 44 is raised from the recessed portions 42 by an amount "h" as herein above described with respect to the other versions.

The present disclosure thus describes a flexible grip for an implement having a handle and particularly for implements which are swung with great force and speed. The grip is molded with a surface having a pattern comprising portions of generally equal area and configuration which are slightly raised from similarly configured intermediate portions; and, the surface of the raised portions is textured such as by buffing for improving manual retention. The raised portion of the surface may be configured in a pattern such as circular, oval, elliptical or polygonal and the pattern may encompass the periphery of the grip. The user is able to tactily discern or feel of the raised portions and the recessed portions which may have a glossy or shiny surface thereby providing a tacky or sticky gripping action. The raised portions may be molded with a shiny or glossy surface and upon removal from the mold, buffed to provide the textured surface.

Obviously, modifications and alterations will occur to others upon reading and understanding the preceding detailed description. It is intended that the disclosure be construed as including all such modifications and alterations and equivalents thereof insofar as they come within the scope of the appended claims.

The invention claimed is:

1. A molded grip for a handle of an implement to be swung with force and speed comprising:

a tubular member formed of flexible material having:

(a) an open end for receiving therein the implement handle;

(b) a substantially closed end distal the open end; and, (c) at least a portion of the outer periphery thereof configured to have integrally thereon a pattern having plurality of spaced raised surfaces having the face thereof textured; and, a plurality of spaces intermediate said raised surfaces and untextured wherein, the area of each of the raised surfaces is in the range of about 100-200 percent (%) of the spaces intermediate the raised surfaces and is raised an amount in the range of about 0.5-2 mm.

2. The grip defined in claim 1, wherein the textured surfaces are formed by buffing after molding.

3. The grip defined in claim 1, wherein the raised surfaces encompass the periphery of the tubular grip.

* * * * *